US005967864A

United States Patent [19]

Koyano et al.

[11] Patent Number: 5,967,864

[45] **Date of Patent: *Oct. 19, 1999**

[54] TWIN JET PROPULSION UNITS

[75] Inventors: Satoshi Koyano; Takaaki Madachi; Yasukiko Henmi, all of Shizuoka, Japan

[73] Assignee: Yahama Hatsudoki Kabushiki Kaisha, Japan

[ * ] Notice: This patent is subject to a terminal disclaimer.

[21] Appl. No.: 08/744,697

[22] Filed: Nov. 7, 1996

[30] Foreign Application Priority Data

Nov. 7, 1995 [JP] Japan ..... 7-313495

[51] Int. Cl.[6] ..... B63H 11/08

[52] U.S. Cl. ..... 440/38; 440/83

[58] Field of Search ..... 440/38, 46, 47, 440/40–42, 81–83; 60/221, 222; 114/220

[56] References Cited

U.S. PATENT DOCUMENTS

| | | |
|---|---|---|
| 1,044,164 | 11/1912 | Goodrich . |
| 1,065,479 | 6/1913 | Taylor . |
| 1,122,647 | 12/1914 | Russel . |
| 1,196,176 | 8/1916 | Tobin et al. . |
| 1,445,467 | 2/1923 | Baer . |
| 3,112,728 | 12/1963 | Krause . |
| 3,641,964 | 2/1972 | Lee . |
| 3,721,208 | 3/1973 | Lampert et al. . |
| 3,871,325 | 3/1975 | Raulerson . |
| 3,977,353 | 8/1976 | Toyama . |
| 4,086,867 | 5/1978 | Stricker et al. . |
| 4,276,035 | 6/1981 | Kobayashi . |
| 4,863,404 | 9/1989 | Salo . |
| 5,231,949 | 8/1993 | Hadley . |
| 5,265,549 | 11/1993 | Cernier . |
| 5,800,222 | 9/1998 | Nanami ..... 440/38 |

FOREIGN PATENT DOCUMENTS

| | | |
|---|---|---|
| 5-50988 | 3/1993 | Japan . |
| 405229484 | 9/1993 | Japan ..... 440/38 |
| 5-229483 | 9/1993 | Japan . |
| 5-330485 | 12/1993 | Japan . |

*Primary Examiner*—Ed Swinehart

*Attorney, Agent, or Firm*—Knobbe, Martens, Olson & Bear, LLP

[57] ABSTRACT

A jet propulsion system for watercraft employs twin impellers contained within a common housing assembly. The housing assembly defines an intake duct that delivers water from a single water inlet opening to impellers supported within the housing. The inlet opining can be positioned centrally on the watercraft to avoid drawing air in during abrupt maneuvering. A dividing wall extends from a location forward of the impellers into the water inlet duct to divide the flow of water well upstream of the impellers. The dividing wall is configured to reduce cross-effects caused of the counter-rotating impellers in the water flow upstream of the impellers without requiring any substantial change in direction of the water flow from the water inlet opening to the impellers.

15 Claims, 7 Drawing Sheets

TWIN JET PROPULSION UNITS

BACKGROUND OF THE INVENTION

1. Field of the Invention

The present invention relates in general to a propulsion device for a watercraft, and in particular to a multiple-jet propulsion device.

2. Description of Related Art

Many watercraft now employ inboard-mounted jet propulsion units due to several distinct advantages over propeller type propulsion systems. For instance, no open propeller poses a hazard with a jet propulsion unit. The unit also does not detract from the watercraft's exterior appearance.

The thrust performance of a jet propulsion unit, however, is commonly limited because the impeller tends to cavitate when driven at a rotational speed above an upper limit. Cavitation reduces the efficiency of the impeller and thus the thrust performance of the jet propulsion unit.

Some prior watercraft have employed several jet propulsion units in order to fully utilize the power output by a high-horsepower engine. The large engine thus drives multiple jet propulsion units, but at a rotational speed that does not cause meaningful cavitation. That is, the engine drives each jet propulsion unit at a rotational speed below the designed upper limit and, thus, cavitation does not occur to such a degree that the efficiency of the jet propulsion unit suffers. The propulsion system thus can provide more thrust without losing efficiency.

Several prior watercraft designs, which employ multiple jet propulsion units, have located the units in a side-by-side arrangement and behind a common, centrally disposed water inlet located on the underside of the watercraft hull. The use of a common, centrally located water inlet reduces the tendency of air being drawn into the jet propulsion units when tuning, as well as provides more continuity of the hull undersurface.

A common water inlet used to feed two or more jet propulsion units, however, often compromises the performance of the jet propulsion units. Each impeller of the jet propulsion unit tends to produce a vortex in the water flow on the inlet side of the unit. This swirling motion in the water flow upstream of the units can cause a counter-effect between the side-by-side units that tends to decrease the efficiency of the jet propulsion units.

SUMMARY OF THE INVENTION

The invention is adapted to be embodied in a jet propulsion system in which the configuration of the intake inhibits undesirable water flow characteristics upstream of the jet propulsion units. The thrust performance of the units consequently improves over prior multi-jet propulsion designs.

One aspect of the present invention thus involves a jet propulsion system comprising an outer housing assembly. The housing assembly defines an intake passage that communicates with a single water inlet opening. A pair of impeller shafts drive a corresponding pair of impellers in opposite rotational directions from each other at a location within the outer housing assembly downstream of the inlet opening. The impellers are supported in a side-by-side arrangement with the impeller shafts lying parallel to and being spaced apart from each other. The intake passage defines separate flow paths which originate at a point downstream of the inlet opening. A dividing wall is arranged between the flow paths and includes a leading edge that extends away from the impellers and upward from a lower end point located near the inlet opening.

Another aspect of the present invention involves a jet propulsion system comprising an outer housing assembly. The housing assembly defines an intake passage that communicates with a single water inlet opening. A pair of impellers rotate about parallel axes in opposite directions from each other and are arranged next to each other at a location downstream of the inlet opening. The intake passage defines separate flow paths which originate at a point downstream of the inlet opening and are separated by a dividing wall. The dividing wall has an arcuate leading edge that extends upward from a point located near the inlet opening and in a direction distal of the impellers. A radius of curvature of the arcuate leading edge is larger than a width of the inlet opening, as measured in a direction normal to the parallel axes about which the impellers rotate.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
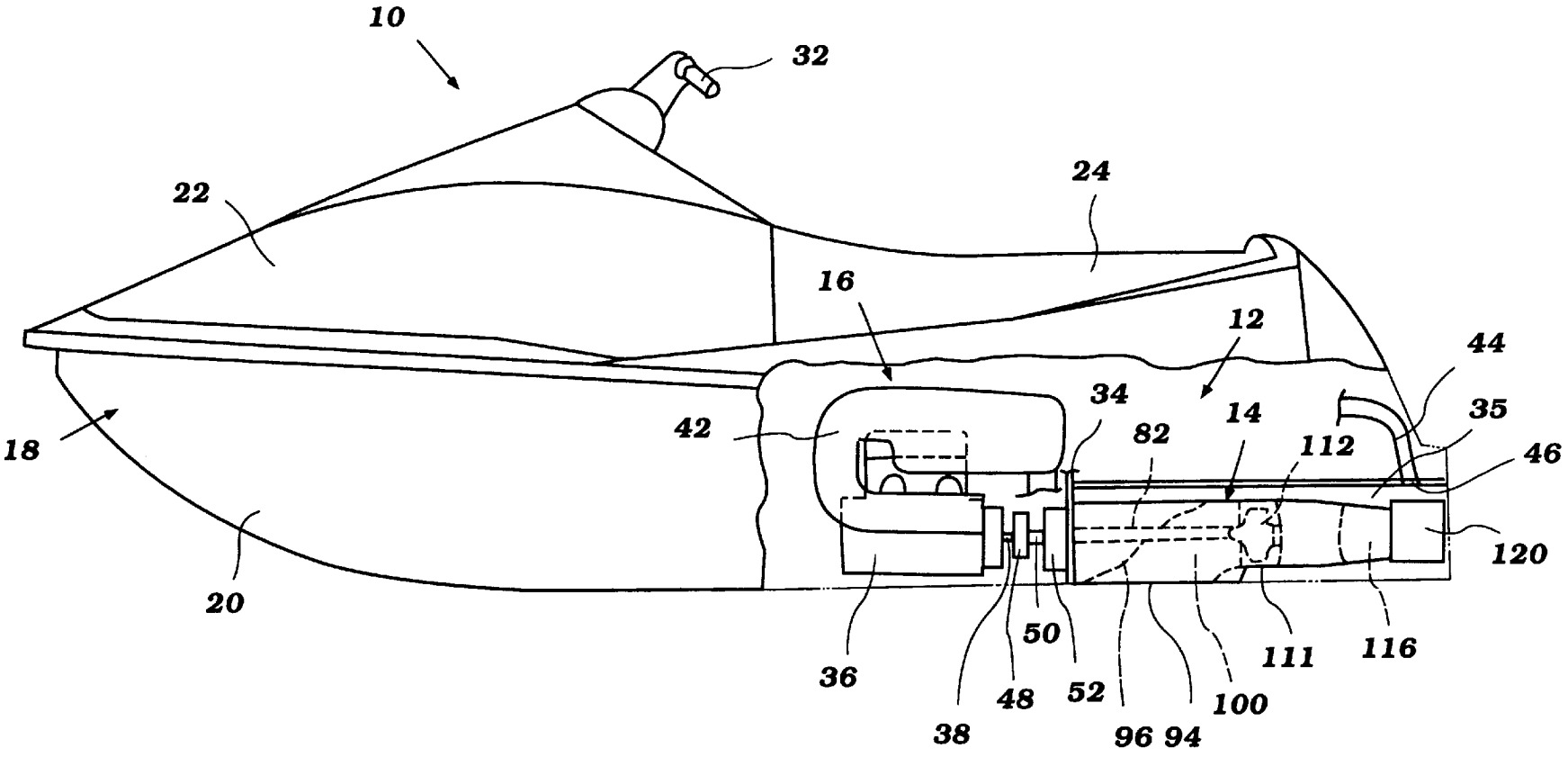
FIG. 1 is a partially sectioned, side elevational view of a watercraft powered by a twin jet propulsion unit which is configured in accordance with a preferred embodiment of the present invention.
Figure 2:
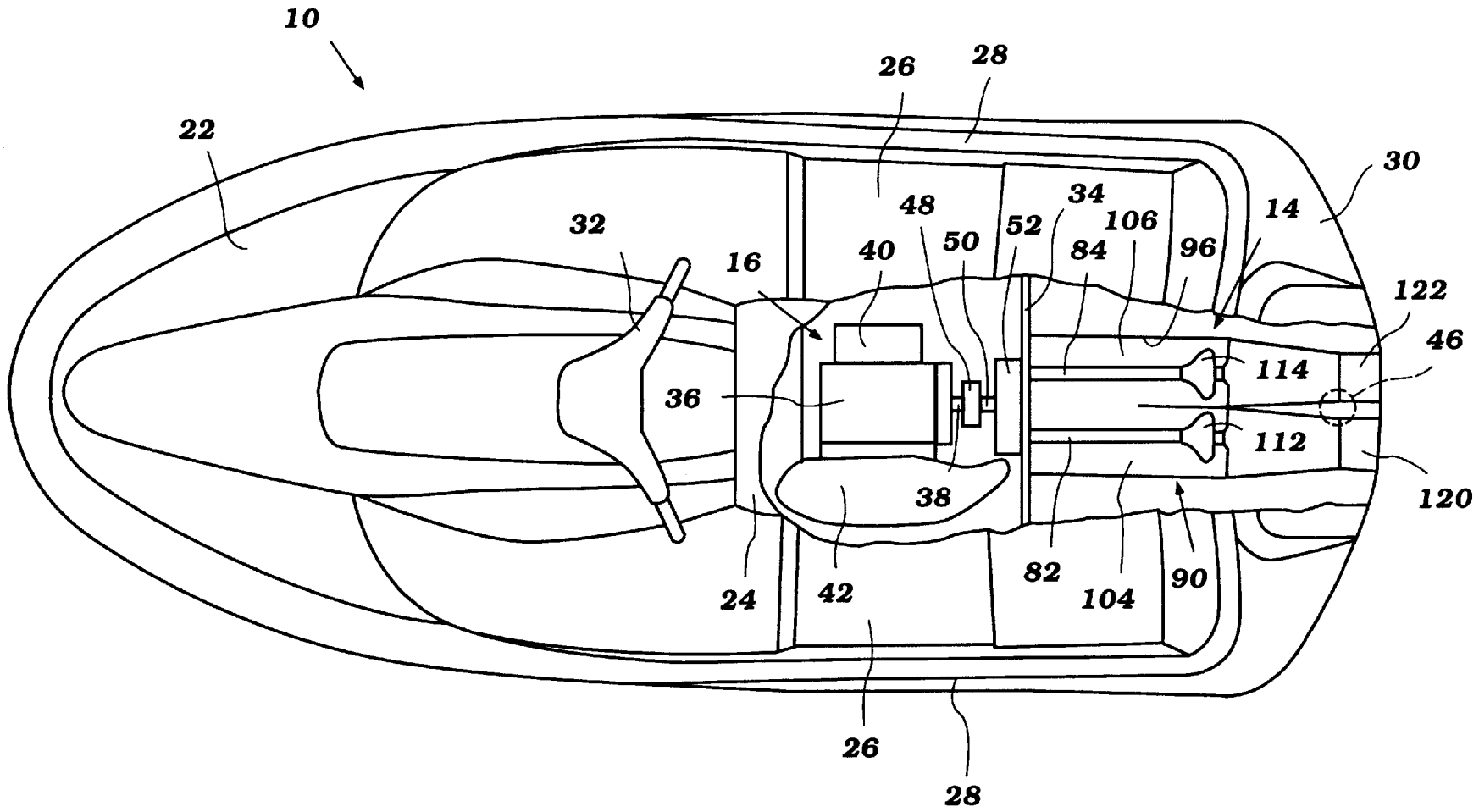
FIG. 2 is a partially sectioned, top plan view of the watercraft of FIG. 1 illustrating an engine and the twin jet propulsion system.

With reference to FIGS. 1–2, a watercraft constructed in accordance with an embodiment of the invention is indicated generally by the reference numeral 10. It is to be understood that the invention deals primarily with the propulsion system for the watercraft, which propulsion system is indicated generally by the reference numeral 12. The propulsion unit includes a powering internal combustion engine 16 and a jet propulsion unit 14 and the associated transmission therefor.

Since the invention deals primarily with the propulsion unit, the description of the watercraft 10 which follows is to be considered as a typical environment in which the invention may be employed. The specific type of watercraft illustrated is a personal watercraft. The invention has particular utility with such watercraft, although its application is not so limited, due to the compact nature of these types of watercraft.

The watercraft 10 is comprised of a hull 18 which may be formed from any suitable material, such as a molded fiberglass reinforced resin, or the like. The hull 18 is formed by a lower hull section 20 and an upper deck section 22. The hull sections 20, 22 are fixed to each other around the peripheral edge in any suitable manner.

The rear portion of the hull 18 defines a passenger's compartment. The passenger's compartment includes a raised centrally positioned seat 24 that is bounded by a pair of foot areas 26 on the opposite sides thereof The seat 26 is configured so as to accommodate one or more riders seated in straddle tandem fashion, with their feet in the foot areas 26.

The foot areas 26 are bounded at their outer peripheral edges by raised gunnels 28 so as to offer protection for the rider or riders. The foot areas 26 open to the rear of the watercraft 10 through a transom 30 so that the riders may easily board the watercraft 10 from the body of water in which the watercraft is operating, as is typical with this type of watercraft.

A handlebar assembly 32 is positioned in the rider's area forward of the seat 24 so as to be operated by the forwardmost-seated rider. The handlebar assembly 32 is coupled to a discharge nozzle (described below) of the jet propulsion unit 14 for steering of the watercraft in a well known manner. In addition, other watercraft controls, such as a throttle, may be provided on the handlebar assembly 32. The throttle may be of the twist-grip type and is coupled to the throttle valve of the engine 16, also in a well known manner, so as to control the speed of the engine 16.

As has been noted, the description of the watercraft 10 is to be considered to be primarily for establishing an environment in which the invention may be utilized. The propulsion system 12 will now be described by continuing reference to FIGS. 1–2, and by additional reference to FIGS. 3 and 4, where this unit is shown in more detail.

The engine 16 is mounted in an engine compartment of the lower hull section 20 on resilient engine mounts. The engine compartment is located in substantial part beneath the seat 24 and forwardly of a bulkhead 34 of the hull 18. The bulkhead 34 is formed at the forward end of a tunnel 35 that is formed on the underside of the lower hull section 20 and in which the jet propulsion unit 14 is positioned. The tunnel 35 is also disposed generally beneath a rear portion of the seat 24.

The engine 16 can be of any well known type. In an exemplary embodiment, the engine can be of a multi-cylinder, in-line and operate on the crankcase compression two-cycle principle. As common with this type of engine, the engine 16 includes a cylinder block assembly 36 that defines the cylinder bores. Pistons (not shown) reciprocate within the bores and are rotatably journaled about the small ends of connecting rods by piston pins. The big ends of the connecting rods in turn are journaled about respective throws of a crankshaft 38.

As has been noted, the engine 16 in the illustrated embodiment operates on a two-cycle crankcase compression principle. As such the engine includes individually sealed crankcase chambers. Each chamber communicates with a dedicated cylinder.

An induction system 40 delivers a fuel/air charge to the crankcase chambers. In the illustrated embodiment the induction system includes an intake air silencer which lies above and to one side of the engine 16. The silencer supplies air to at least one charge former (e.g., a carburetor). The engine 16 desirably includes a number of charge formers equal to the number of cylinders, and the charge formers are floatless-type carburetors; however, it is understood that other types of charge formers, such as, for example, fuel injectors also can be used with the engine 16.

An exhaust manifold is attached to the opposite side of the cylinder block 36 and communicates with exhaust discharge ports associated with each cylinder. The exhaust manifold delivers exhaust byproducts to an exhaust system 42 for discharge.

The exhaust system 42 includes a C-shaped pipe that is attached to the exhaust manifold. The C-pipe delivers exhaust gases from the exhaust manifold to an expansion chamber located above and to the side of the engine 16. The expansion chamber lies on a side of the engine cylinder block assembly 36 opposite of the induction system 40.

The exhaust system desirably includes a flexible pipe that connects the expansion chamber to a water trap device. Both the water trap device and the flexible pipe are disposed along one side of the watercraft hull tunnel 35.

An exhaust pipe 44 extends from an outlet end of the water trap device and wraps over the top of the tunnel 35 to a discharge end 46. The discharge end 46 is located on the top side of the tunnel 35 and in a position opening between the nozzles of the twin jet pumps of the propulsion unit 14.

As best seen in FIGS. 1 and 2, the crankshaft 38 has an exposed rear portion which is coupled to an elastic coupling 48. The elastic coupling 48, in turn, transmits power to a short transmission input shaft 50 which extend rearwardly to a transmission 52.

The transmission 52 thus is interposed between the engine output shaft 38 and the jet propulsion unit 14 for driving the two impellers of the jet propulsion unit. As best seen in FIGS. 3–6, the transmission 52 includes an outer housing 54. The outer housing 54 is mounted on the front of the bulkhead 34 within the engine compartment and defines a transmission casing. A cover plate 56 encloses the casing.

Figure 5:
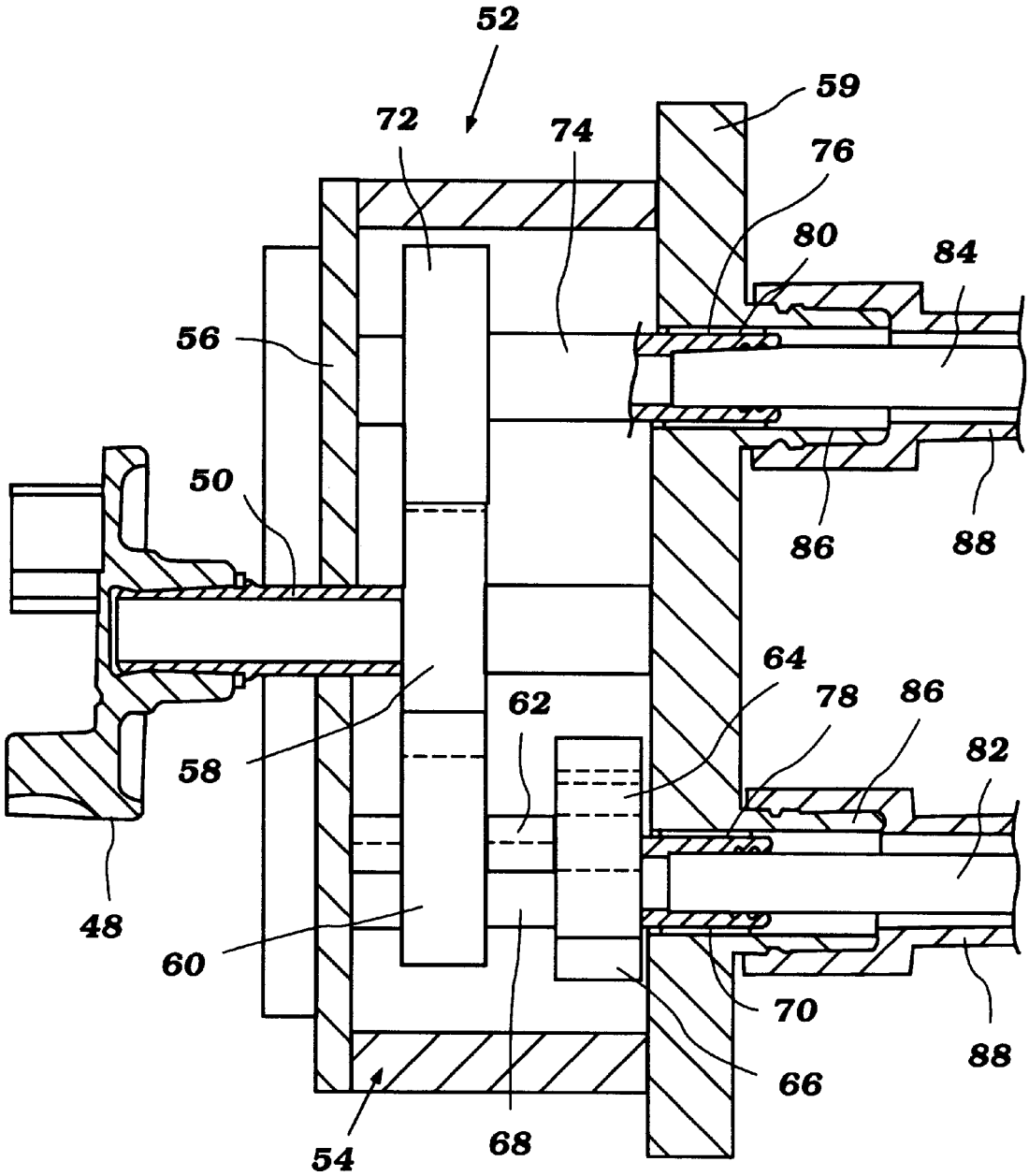
FIG. 5 is an enlarged, sectional, top plan view of the transmission of FIG. 4.
Figure 6:
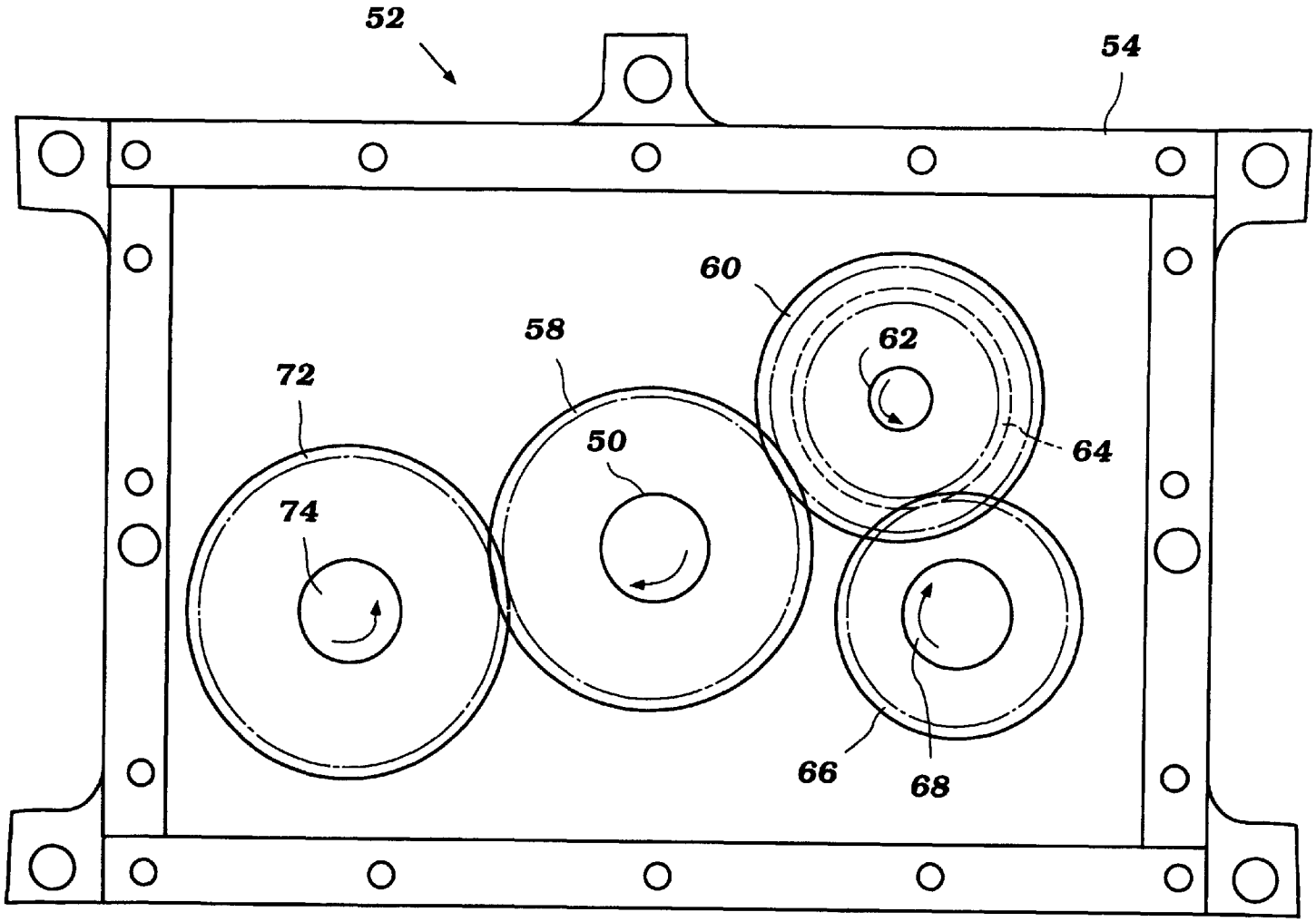
FIG. 6 is a front elevational view of the transmission of FIG. 4.

As best seen in FIGS. 5 and 6, the transmission input shaft 50 has affixed to it within the transmission case a transmission input gear 58. The forward end of the input shaft 50 desirably is journaled by means of a pair of ball bearing journals carried by the transmission cover plate 56. The aft end of the input shaft desirably is journaled by a roller bearing that is carried by a rear wall 59 of the main transmission housing 54. A pair of thrust bearings also can provide axial location for the transmission input shaft 50.

The transmission input gear 58 drives an intermediate driven gear 60 that has a splined connection to an intermediate shaft 62 which is journaled for rotation about an axis that lies above and to the side of the transmission input shaft 50. The intermediate shaft 62 desirably is journaled by a pair of ball bearings carried in a bearing carrier which is fixed to the transmission cover plate 56 at its forward end. In addition, and like the transmission input shaft 50, the intermediate shaft 62 is journaled at its rear end by a needle bearing assembly carried by the transmission case rear wall 59. A pair of thrust bearings desirably provide axial location for the transmission intermediate shaft 62.

The ratio of diameters between the transmission input gear 58 id the intermediate driven gear 60 may be unitarily or, if desired, there may be a stepped-down ratio between the gears 58, 60. A speed reduction can be obtained, if needed, to permit higher engine speeds without causing cavitation. In either event, the intermediate driven gear 60 has associated with it a transmission gear 64 which has a splined connection with the intermediate shaft 62 and therefore rotates with the intermediate driven gear 60.

The transmission gear 64 drives a first driven gear 66 which is affixed for rotation with a first transmission output shaft 68. As seen in FIG. 5, a needle bearing assembly 70 journals the rear end of the first output shaft 68 within a respective bore through the rear wall 59. In a like manner, the front end of the first output shaft is suitably supported and journaled within the transmission outer housing 54.

The transmission 52, through the above-described gear train, causes the first output shaft 68 to rotate in the same rotational direction as that of the input shaft 50. In addition, the gear ratios are such that the rotational speed of the input shaft 50 and the first output shaft 68 are approximately equal.

The transmission input gear 58 also drives a second driven gear 72 that has a splined connection to a intermediate shaft 62 intermediate shaft 62 which is journaled for rotation about an axis that lies at the same vertical level as the axis of the first output shaft 68 and slightly below and to the side of the input shaft 50. The second output shaft 74 desirably is journaled by a pair of ball bearings carried in a bearing carrier which is fixed to the transmission cover plate 56 at its forward end. In addition, and like the first output shaft 68, the second output shaft 74 is journaled at its rear end by a needle bearing assembly 76 carried by the transmission case rear wall 59.

The ratio of diameters between the transmission input gear 58 and the second driven gear 72 can be unitary or, if desired, there can be a stepped-down ratio between the gears 58, 72. As mentioned above, a speed reduction can be obtained, if needed, to permit higher engine speeds without causing cavitation. The first and second output shafts 68, 74, however, desirably rotate at the same speed. Thus, in the illustrated embodiment, the input gear 58 and the second driven gear 72 are of the same diameter. The gear train formed by the input gear 58 and the second driven gear 72 thus causes the second output shaft 74 to rotate in an opposite rotational direction to that of the input shaft 58 (as well as that of the first output shaft 68), but at the same rotational speed.

As best seen in FIG. 5, each of the transmission output shafts 68, 74 have a respective end portion 78, 80 that extends behind the transmission case rear wall 59 and toward the bulkhead 34. Each of the ends 78, 80 is formed with an internally splined opening that receives the externally splined end of a respective impeller shaft 82, 84.

The rear wall 59 includes an annular flange 86 that circumscribe the bores through which the end portions 78, 80 of the output shafts 68, 74 extend. The exterior of each flange 86 carries an external thread.

A protective tube 88 shrouds each of the impeller shafts 82, 84. Each tube 88 includes an enlarged front end which fits over the corresponding annular flange 86 and cooperates with the respective threads to attach the tube to the transmission case rear wall 59.

Figure 3:
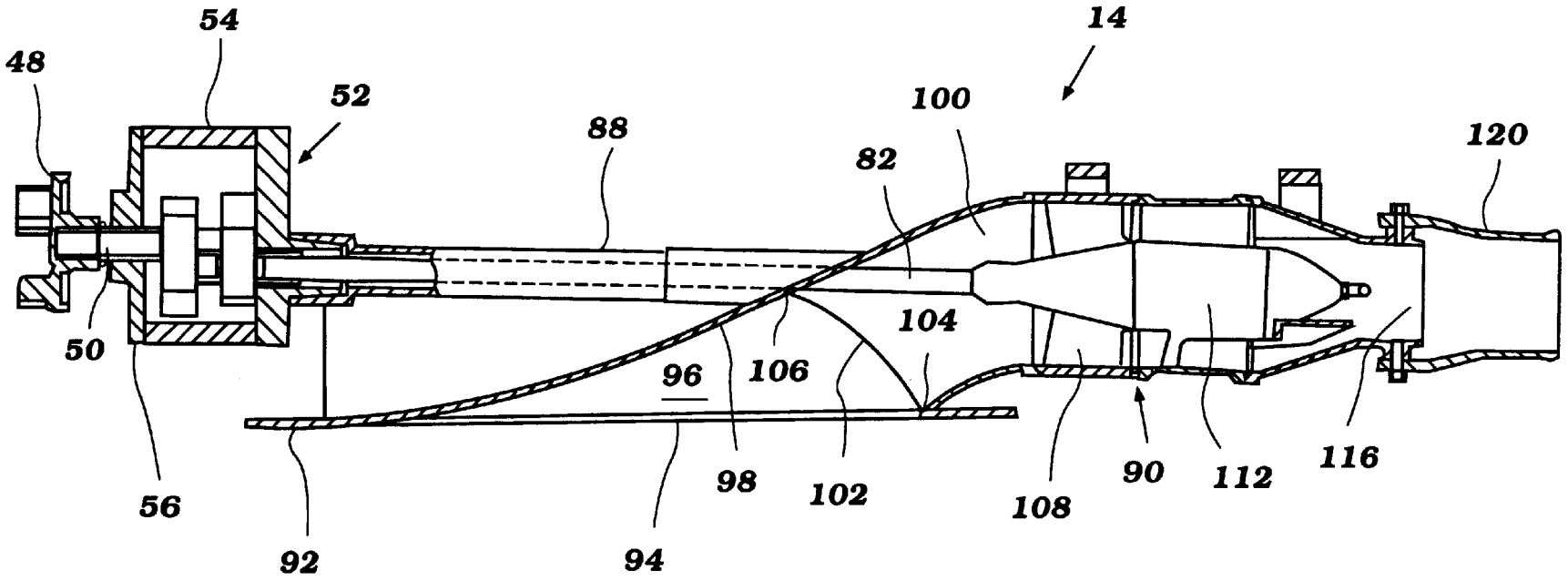
FIG. 3 is an enlarged, side elevational view of the twin jet propulsion unit and associated transmission shown apart from the watercraft and with the transmission shown in section.
Figure 4:
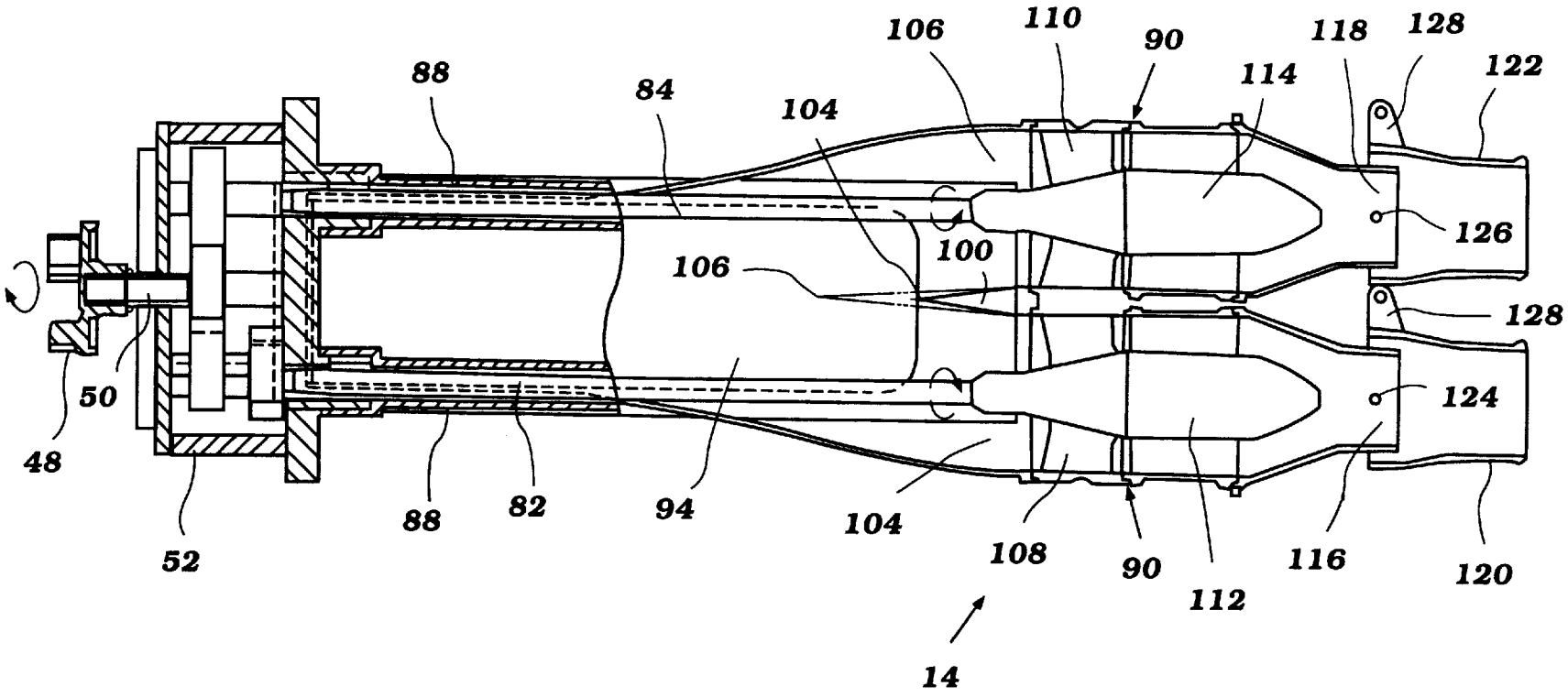
FIG. 4 is an enlarged, top plan view of the twin jet propulsion unit of FIG. 3 showing a section of the transmission.

As best seen in FIGS. 3 and 4, the impeller shafts 82, 84 extend from the transmission 52 to the jet propulsion unit 14. The jet propulsion unit 14 includes an outer housing assembly, indicated generally by the reference numeral 90. The outer housing assembly 90 can be formed of a single-piece construction or a multiple-part construction.

The housing 90 includes a water inlet opening defining portion at its forward end. This portion includes a lower flange-type plate 92 that is disposed in substantial alignment with the underside of the lower hull section 20 and provides a closure at the forward end of the tunnel 35 in which the jet propulsion unit 14 is mounted.

Figure 7:
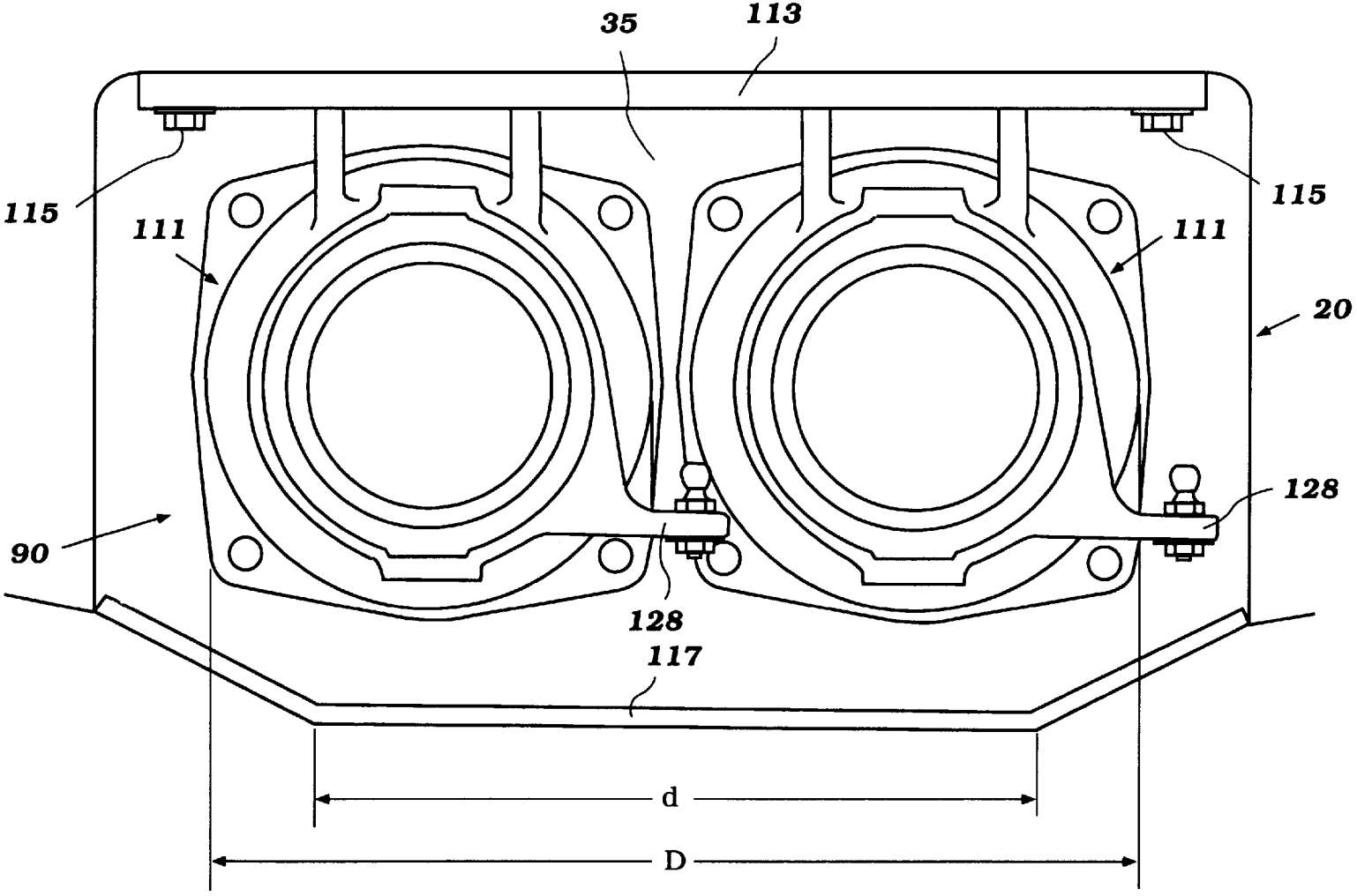
FIG. 7 is a rear elevational view of the twin jet propulsion unit of FIG. 3.

The housing assembly 90 also defines a single water inlet opening 94 which faces downwardly and which serves a water inlet duct 96 formed by a duct-forming portion 98 of the housing 90. The inlet opening 94 desirably has a generally rectangular shape with a constant width d (as measured in a lateral direction normal to the axes of the impeller shafts 82, 84 as shown in FIG. 7); however, the inlet opening 94 can have any of a variety of shapes. In addition, although the housing assembly 90 can define the inlet opening 94, the opening 94 can in the alternative be formed in part by the hull itself. In either event, the opening 90 desirably is positioned centrally in the hull undersurface and has a width d which is no larger than the width of the riders seat 24.

The duct-forming portion 98 is provided in part with an internal wall 100 which has a curved forward end or leading edge 102 that divides a portion of the water inlet duct 96 into a pair of flow paths 104, 106 (see FIG. 4). The leading edge 102 extends from a lower end point 104 to an upper end point 106 that lies in front of the lower end point such that the leading edge 102 of the wall 100 extends forwardly of the rear end of the opening 94 to assist in this separation. The lower end point 104 of the wall 100 desirably is located at the rear end of the opening 94 so that the water flowing from the inlet opening 94 to the individual impellers (described below) does not experience a significant change in direction. However, the wall 100 and particularly its upper end 106 extends sufficiently forwardly so that the swirling motion generated to the inlet flow entering each impeller will not be transmitted to the other.

The leading edge 102 of the wall 100 also has an arcuate shape to lessen the turbulence introduced by the wall 100 in the water flow upstream of the impellers. The leading edge 102 desirably has a radius of curvature which is greater than the width d of the inlet opening 94 in order to further isolate the water flow through the separate paths 104, 106 from the effects of the adjacent impeller.

Impellers 108, 110 of the jet propulsion unit 14 are affixed in a suitable manner to the impeller shafts 82, 84, respectively. Each impeller is located in an impeller housing 111. As best seen in FIG. 4, the impeller housings 111 are arranged to lie side-by-side within the housing assembly 90. The housings 111 desirably are juxtaposed in order to minimize the overall width D across the housings (i.e., across the housing assembly 90).

As best seen in FIG. 7, the width d of the inlet opening 94 desirably is smaller than the width D of the housing assembly 90. The smaller width d of the inlet opening 94 further prevents drawing air in during abrupt maneuvering.

Each housing 111 is integrally formed with a mounting plate 113 of the housing assembly 90. In this manner, the mounting plate 113 interconnects together the housings 111.

Bolts 115 secure the mounting plate 113 to an upper side of the hull tunnel 35. The lower side of the tunnel 35 behind the rear end of the inlet opening 94 is closed by a ride plate 117 in a known manner.

As best seen in FIGS. 3 and 4, the rear ends of the impeller shafts 82, 84 are journaled within nacelles 112, 114 that are formed forwardly of separate discharge nozzle portions 116, 118 of the jet propulsion unit housing assembly 90.

Steering nozzles 120, 122, associated with each discharge nozzle 116, 118, are supported on the discharge nozzle portions 120, 122 by respective vertically extending pivot pins 124, 126 for pivoting of the steering nozzles 120, 122. The steering nozzles 120, 122 are interconnected through a suitable linkage system with the handlebar assembly 32 for steering in a well known manner. The linkage system can include a cable which is attached to an associated lever arm 128 of the respective steering nozzle 120, 122.

The present propulsion system 12, which uses twin jet pumps, is capable of producing more thrust than prior units which employ only a single pump. The separate flow paths formed by the dividing wall also improve the efficiency of the pumps while obtaining the advantages of using a single inlet opening. The dividing wall is configured to improve the isolation between the jet pumps so that each impeller's action will not interfere with the other.

In addition, the use of counter-rotating impellers also eliminates the need for straightening vanes as any lateral (i.e., side) component of the produced thrust vector from the jet propulsion unit nozzles tend to be canceled out. In other words, any sideward thrust produced by one impeller is counteracted by a corresponding but opposing sideward thrust of the other impeller. In this manner, the handling of the watercraft is improved.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A jet propulsion system comprising an outer housing assembly defining an intake passage communicating with a single water inlet opening, a pair of impellers driven by a pair of impeller shafts which drive the impellers in opposite rotational directions from each other at a location within the outer housing assembly downstream of the inlet opening, the impellers being supported in a side-by-side arrangement with the impeller shafts lying parallel to and being spaced apart from each other, the intake passage defining separate flow paths which originate at a point downstream of the inlet opening, and a dividing wall arranged between the flow paths and including a leading edge that extends away from the impellers and upward from a lower end point located near the inlet opening.

2. A jet propulsion system as in claim 1, wherein the leading edge of the dividing wall has an arcuate shape.

3. A jet propulsion system as in claim 2, wherein a radius of curvature of the arcuate leading edge is larger than a width of the inlet opening, as measured in a direction normal to axes of the impeller shafts.

4. A jet propulsion system as in claim 1, wherein an upper end point of the leading edge lies forward of the lower end point of the leading edge.

5. A jet propulsion system as in claim 1, wherein an upper end point of the leading edge lies below a plane defined by the axes of the impeller shafts.

6. A jet propulsion system as in claim 1, wherein the inlet opening has a width, as measured in a direction normal to axes of the impeller shafts, which is about equal to a spacing between the parallel impeller shafts.

7. A jet propulsion system as in claim 6, wherein each impeller is supported within a respective impeller housing, and the width of the inlet opening is smaller than a distance measured across the impeller housings in a direction normal to the axes of the impeller shafts.

8. A propulsion system as in claim 1, wherein the lower end point of the leading edge is located at a rear side of the inlet opening.

9. A jet propulsion system comprising an outer housing assembly defining an intake passage communicating with a single water inlet opening, a pair of impellers rotating about parallel axes in opposite directions from each other and being arranged next to each other downstream of the inlet opening, the intake passage defining separate flow paths which originate at a point downstream of the inlet opening and are separated by a dividing wall, the dividing wall having an arcuate leading edge that extends upward from a point near the inlet opening and in a direction distal the impellers, a radius of curvature of the arcuate leading edge being larger than a width of the inlet opening, as measured in a direction normal to the parallel axes about which the impellers rotate.

10. A jet propulsion system as in claim 9, wherein the leading edge extends between an upper end point and an upper end point.

11. A jet propulsion system as in claim 10, wherein the upper end point lies forward of the lower end point.

12. A jet propulsion system as in claim 10, wherein the upper end point lies below a plane defined by the rotational axes of the impellers.

13. A jet propulsion system as in claim 9, wherein a distance between the rotational axes of the impellers is about equal to the width of the inlet opening.

14. A jet propulsion system as in claim 9, wherein the inlet opening generally has a constant width in a direction parallel to the rotational axes of the impellers.

15. A jet propulsion system as in claim 9, wherein each impeller is supported within a respective impeller housing with the impeller housings arranged in a side-by-side relationship, and the width of the inlet opening is smaller than a distance across the impeller housings in a direction normal to the rotational axes of the impellers.

* * * * *